United States Patent [19]

Chiari et al.

[11] Patent Number: 4,571,930

[45] Date of Patent: Feb. 25, 1986

[54] AUTOMATIC DOFFING DEVICE FOR RING SPINNING AND/OR TWISTING FRAMES, IN PARTICULAR IN MACHINES FOR PRODUCING LARGE PACKAGES

[75] Inventors: Natale Chiari; Giuseppe Inverardi, both of Cologne Bresciano, Italy

[73] Assignee: Officina Meccanica Tessile Edera S.p.A., Cologne Bresciano, Italy

[21] Appl. No.: 588,706

[22] Filed: Mar. 12, 1984

[30] Foreign Application Priority Data

Nov. 16, 1982 [IT] Italy ..... 24278 A/82

[51] Int. Cl.[4] ..... D01H 9/08; D01H 9/14

[52] U.S. Cl. ..... 57/274; 57/270; 57/276; 294/114

[58] Field of Search ..... 57/270, 274, 275, 268, 57/276; 294/114

[56] References Cited

U.S. PATENT DOCUMENTS 1,486,624 3/1924 Bajus ..... 294/114 X 2,628,468 2/1953 Greene ..... 57/274

3,686,847 8/1972 Vignon ..... 57/274

*Primary Examiner*—John Petrakes

*Attorney, Agent, or Firm*—Holman & Stern

[57] ABSTRACT

An automatic doffing device for ring spinning and/or twisting frames, in particular in machines for producing large packages, which comprises a conveyor arranged to convey the empty tubes into a vertical position corresponding with each of the spindles of the spinning and/or twisting frame, a second conveyor arranged to take away the full cops, and a gripper assembly arranged to effect the mutual transfer of the full cops and empty tubes between the conveyor supporters and the spindles.

The doubling of the conveyors and their location at the top of the spinning frame creel in a position overlying the spindles enables automatic doffing to be carried out on spinning and/or twisting frames without any regard for the size of the package (cop diameter and tube length).

7 Claims, 25 Drawing Figures

37
38
30
32
34
35
33
32
30
39
39
38
17
30
32
34
35
36
33
30
32
25
40
41
41
42
42
43
18

AUTOMATIC DOFFING DEVICE FOR RING SPINNING AND/OR TWISTING FRAMES, IN PARTICULAR IN MACHINES FOR PRODUCING LARGE PACKAGES

This invention relates to an automatic doffing device for ring spinning and/or twisting frames, in particular in machines for producing large packages.

The doffing operation in ring spinning and/or twisting frames is that operation by which the yarn, packaged into cops on the spindles, is removed and is replaced on said spindles by new empty conical tubes on which the yarn produced in the next production cycle is to be collected. Devices are known for automatically doffing the cops and loading the empty tubes on to the spindles by means of an assembly of grippers which are caused to move in a determined sequence vertically and laterally.

Said devices also comprise a unit for feeding empty tubes and conveying away the full cops, its purpose being to collect the empty tubes from a tube arranger-loader, to move the tubes into a vertical position in front of the spindles, to receive the full cops removed from the spindles, and to convey the cops into a collection container. This latter unit is constituted by a conveyor provided with supporters spaced apart by a distance equal to the distance between the spindle centres of the spinning frame, these supporters being arranged to receive the tubes and the cops. The gripper assembly must unload the full cops from the spindles in order to deposit them on to the conveyor supporters, and must withdraw the empty tubes from the conveyor supporters in order to load them on to the spindles.

These loading and unloading operations create difficulties and limitations in the application of known automatic doffing devices. In this respect, as said conveyor supporters can obviously not receive the empty tubes and full cops simultaneously, special means must be provided in order to enable the empty tubes to be replaced by the full cops on the supporters located on the conveyor.

A first known method is to alternately position, on a conveyor, supporters which are designed to receive empty tubes and supporters which are designed to receive full cops. By this means, two supporters on the conveyor are associated with each spindle of the spinning frame.

The outcome of this method is that there is an unsurpassable limit to the diameter attainable by the full cops for a given distance between spindle centres on the spinning frame, or alternatively a greater distance between spindle centres with the possibility of installing a smaller number of spindles in the same space, for a given maximum cop diameter. Moreover, special inflatable pneumatic elements must be used for withdrawing the tubes and cops, because of the restricted free space between the tubes and cops on the conveyor.

The main drawback of this gripping system, which acts on the top of the tubes, is that during the doffing of the cops from the spindles it is not possible to control the binding yarn turns which are formed during the descent of the carriage, the result being unwinding and the creation of long yarn residues on the spindle, these being responsible for a large number of breakages at the next start. A second method uses special bifunctional grippers arranged to simultaneously grip and retain both the empty tubes and the full cops. Such a device provides for the grippers, having withdrawn and retained all the empty tubes from the conveyor, to successively remove all the full cops from the spindles by unloading them on to the conveyor-mounted supporters, and to load the empty tubes on to the spindles.

In this case limitations are created either in the maximum diameter of the cops or in the distance between the spindle centers on the spinning frame, because of the bulk of the bifunctional grippers. Furthermore, and this is valid for both the aforesaid methods, special perfectly sized tubes must be used in order to allow their reliable gripping by the inflatable withdrawal elements or by the bifunctional grippers.

A third method provides for an additional line of supporters to the side of each of the units for feeding the tubes and for conveying-away the full cops, to act as a parking system for the tubes during the unloading of the cops. This method does not imply the limitations of the two preceding methods, but requires a gripper working cycle which is more complicated and mechanically more costly.

In all these methods, although based on different concepts, the relative heights of the various members, with reference to a cross-section through the spinning frame, are fixed.

The runway for the unit for feeding empty tubes and conveying-away full cops is fixed to the base of the spinning frame support shoulders, as close as possible to the floor.

The supporters which receive the tubes and cops are mounted on the upper face of the conveyor so as to centre and support tubes and cops which extend upwards from the travelling surface of the conveyor over their entire length.

The gripper assembly is constituted by a section bar extending over the entire length of the spinning frame parallel to its longitudinal axis, and on which the grippers are fixed spaced-apart by a distance equal to the distance between the centres of two adjacent spindles on the spinning frame, and aligned with them.

Said section bar is connected to the spinning frame support shoulders by means of a mobile articulated system which enables it to make the necessary vertical and lateral movements for executing the change-over of cops and tubes from the spindles to the supporters and viceversa.

The minimum height from the floor at which the gripper assembly can be fixed is given by the sum of three dimensions, the first being the distance from the floor to the upper face of the conveyor belt for the unit for feeding empty tubes and conveying-away full cops, the second being the height of the tube, and the third being the height of the section bar which supports the grippers. The increase in the package size from the normal cop diameter of 48–55 mm and tube length of 280–300 mm to a cop diameter of 120 mm and a tube length of up to 600 mm creates a series of problems in the use of known doffing devices.

The first problem common to the three methods is the accessibility to the spinning frame both during the loading of the tubes on to the conveyor by the tube arranger-loader and during the unloading of the cops.

Spinning and/or twisting frames for large formats are known to comprise a platform in front of the spindles on to which the operator has to climb in order to correctly halt the spindle, to reconnect any broken yarn, and/or to mend any breakage in one of the feed belts.

The presence of a barrier of tubes or cops up to a height of 950 mm during the described stages, which last for 20 minutes in a winding cycle of less than one hour, prevents correct operation of the spinning frame.

In the first aforesaid method, the increase in the package size also leads to unreliability of the pneumatic gripping system in the lifting of cops each weighing 1.5 kg, and comprising yarns of considerable breaking strength.

Again, as the package size increases, the bifunctional grippers used in the second aforesaid method assume a size which makes them unable to be used usefully and economically.

Consequently, machines for producing large packages have used manual doffing up to the present time, leading to a considerable time wastage and use of personnel.

The object of the present invention is to obviate the aforesaid drawbacks and to create an automatic doffing device of low complexity and simple operation, which is particularly suitable for use in ring spinning and/or twisting frames for large packages, and allows easy access to the spindles and to other apparatus of the spinning frame.

This object is attained according to the present invention by an automatic doffing device for spinning and/or twisting frames, in particular in machines for producing large packages, composed essentially of means for feeding empty tubes and conveying-away full cops, and of horizontal and vertical drive units supporting a gripper assembly composed of a set of grippers disposed spaced-apart by a distance equal to the distance between the spindle centres of the spinning and/or twisting frame, characterised in that said feed and conveying-away means consist of two independently driven overhead conveyors disposed longitudinally and side-by-side, the first of said conveyors being provided with supporters arranged to support empty tubes and the second being provided with supporters arranged to support full cops, said supporters being disposed pointing downwards when in the active portion of the conveyors.

Structural and operational characteristics of the device according to the invention and the advantages deriving therefrom will be more apparent from the description of a practical embodiment given hereinafter and illustrated on the accompanying diagrammatic drawings in which.

Figure 1:
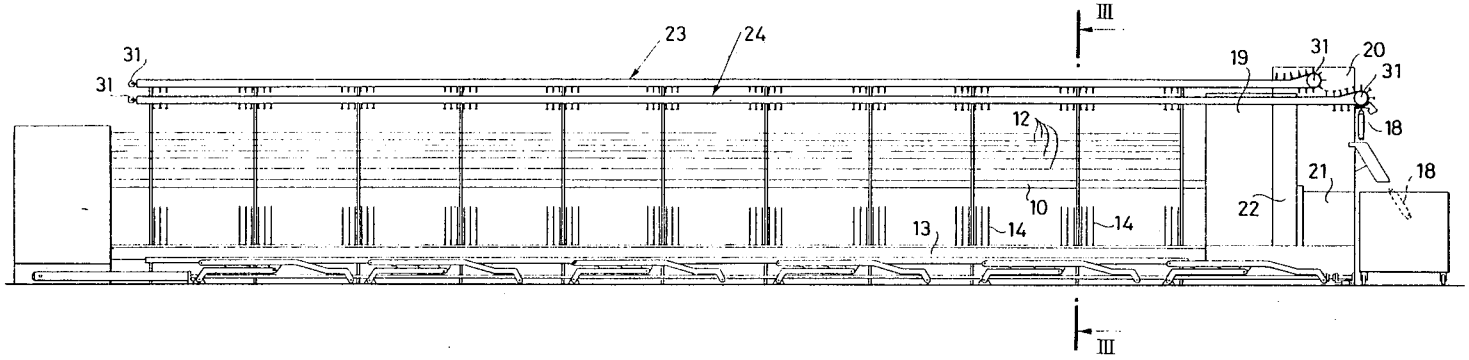
FIG. 1 is a diagrammatic front view of a spinning frame to which the device according to the invention is fitted.
Figure 2:
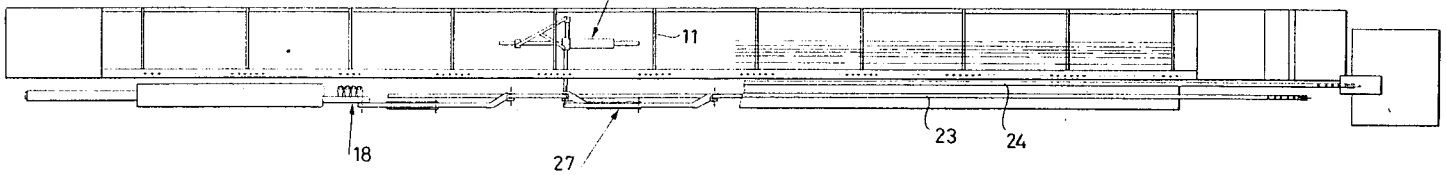
FIG. 2 is a corresponding partly sectional diagrammatic plan view.

With reference to the drawings, FIGS. 1 and 2 diagrammatically show a ring spinning frame provided with an automatic doffing device according to the present invention.

The spinning frame, of conventional ring type, is constituted by a load-bearing structure 10 provided with intermediate shoulders 11 which upperly carry a drafting system 12 and lowerly carry a spindle bank 13 which rotatably supports spindles 14 spaced-apart by a constant distance along the spinning machine face.

A ring carriage 15 (FIG. 3) driven with vertical reciprocating motion supports rings 16 for distributing the yarn, originating from the drafting system 12, on to conical tubes 17 mounted on the spindles 14, which are provided with collection rings 99 so as to form yarn cops or bobbins 18.

The so-called spinning frame tail, indicated overall by 19, is positioned at one end of the spinning frame, and houses control and operating devices and apparatus. A cabinet 20, positioned close to the tail 19, comprises a container 21 for empty tubes 17, and an arranger-loader unit 22 for said tubes, both of conventional construction.

The said components are not described in greater detail because they do not directly form the subject matter of the present invention, which specifically relates to an automatic doffing device, in particular for large-dimension cops.

Said automatic doffing device is essentially constituted by a pair of overhead conveyors 23 and 24 suspended from the spinning frame creel 25, the first (23) being arranged to support the empty tubes 17 and the second (24) being arranged to receive the cops 18 full of yarn, after removal from the spindles 14.

Operationally cooperating with said conveyors 23 and 24, there are provided a first articulated horizontal drive unit 26 and a second vertical such unit 27, which support a gripper assembly 28 composed of a set of grippers 29, of number at least equal to the number of spindles 14.

The overhead conveyors 23 and 24 are each constituted essentially by a drag belt 30, formed for example from a chain of steel strips which passes endlessly about end pulleys 31, one of which is suitably motorised.

Said belt 30 drags shoes 32 which are slidable on the opposing lower flanges 33 and upper flanges 34 of a continuous section bar 35, which is fixed to the spinning frame creel 25 by way of supports 36 and a cover 37.

The shoes 32 are spaced apart by a distance equal to the distance between the centres of the spindles 14, and are of a number not less than the number of spindles.

Specifically, the shoes 32 of the conveyor 23 comprise essentially cylindrical peg-shaped supporters 38 which are connected to the belt 30 and point downwards when in the active portion of the conveyor, and are provided laterally with barrel springs 39 arranged to receive and engage in the empty tubes 17, in their various dimensions. The shoes 32 of the conveyor 24 carry forked supporters 40 connected to the belt 30, which point downwards when in the active portion of the conveyor and at the end of the fork carry toothed sectors 41 which are arranged to receive the yarn cops 18.

Said sectors 41, which rotate about pins 42, are normally kept in their maximum mutual approach position by spiral springs 43 mounted on said pins 42.

The horizontal drive unit 26, which is connected to the floor by way of a series of pairs of supports 44 and 45, is constituted by a longitudinal rod 46 which slides in seats 47 in the supports 45, and is activated by at least one double acting cylinder 48. The piston 49 of said cylinder 48 is provided on the rod 46, and is driven by virtue of the hydraulic connections 50 which act alternately by charging and discharging.

The supports 44 and 45 support the ends of guide rods 51, on which their slide respective sliders 52, to which the vertical drive unit 27 is connected, said sliders 52 being operated at 53 by connecting rods 54.

A series of levers 55, hinge-connected at their ends to the rod 46 and to the rods 54 respectively, are connected by hinges 56, disposed in their intermediate part, to connecting rods 57 which oscillate about pins 58 disposed on the supports 45. The movement of the sliders 52 and rods 54 is controlled by suitably positioned limit switches 59.

The vertical drive unit 27 is disposed on supports 60 rigid with the sliders 52 and slidable together with said sliders transversely to the spinning frame.

Said unit 27 is constituted by a longitudinal section bar 61 which constitutes one side of an articulated parallelogram, of which the opposite side is a longitudinal rod 62 slidable in relative seats 63 provided in the supports 60.

A series of rods 64, pivoted at their ends 65 to the bar 61 and at their ends 66 to the rod 62, represent the other sides of the parallelogram and are compelled to swivel by means of pivots 67 provided at one end of a like number of struts 68.

At their other end, said struts 68 are pivoted at 69 to the supports 60, and upperly carry leaf springs 70.

The rod 62 is moved by a double acting cylinder 71 disposed at one of its ends and connected to the support 60, and fed through connections 72 which alternately charge and discharge.

The various positions of rise of the unit 27 are controlled by a set of suitably located limit switches 73.

The longitudinal section bar 61 supports the gripper assembly 28, which is composed of a series of grippers 29 of a number equal to the number of spindles 14 and spaced-apart by a distance equal to the distance between the centres of said spindles 14.

Each gripper 29 is constituted by a profiled body 74 comprising a central through bore 75 and four prismatic blind seats 76 which taper towards the end, their longitudinal axis lying in planes passing through the centre of the bore 75.

Within these planes there rotate four sectors 77, which are carried by pins 78 normal to the planes of rotation and fixed into bores 79 formed in the walls of the seats 76.

On each pin 78 there is coaxially mounted a torsion spring 80 which keeps the sectors in positions of maximum mutual approach, and has its ends connected to the sector 77 and to the pin 78 respectively. The sectors 77, which are for example of semi-rigid plastics material, have a toothed lower surface 81, a point 82 of soft material, and a C-shaped flat spring 83 connected to their upper surface.

A further four pins 84, connected to the walls of the seats, are positioned in a plane parallel to that defined by the pins 78, but at a lower level in the tapered part of the seats 76.

The pins 84 rotatably support four smaller sectors 85, which are kept abutting against the base of the seats 76 by torsion springs 86 coaxial to the pins 84 and acting between the sectors 85 and the walls of said seats 76.

Figure 15:
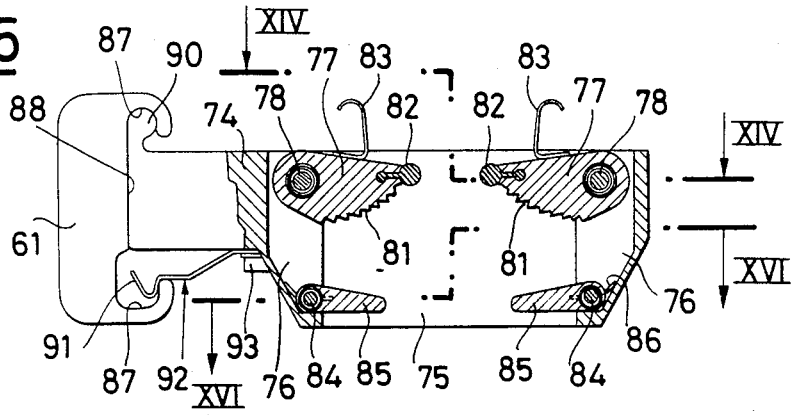
FIG. 15 is a section through the gripper of FIG. 14 taken on the line XV—XV of FIG. 14.
Figure 16:
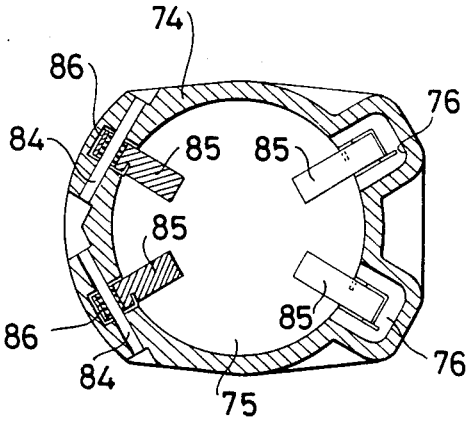
FIG. 16 is a section through the gripper of FIG. 14 taken on the line XVI—XVI of FIG. 15.
Figure 17:
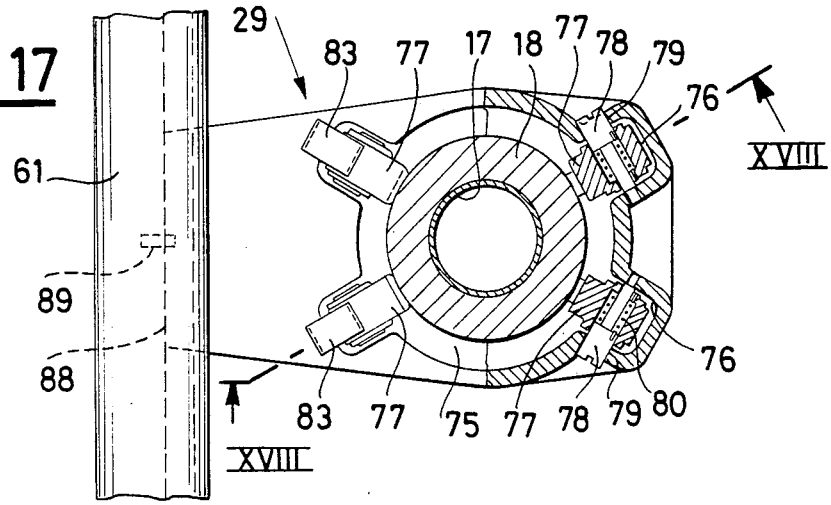
FIG. 17 is a sectional plan view on the line XVII—XVII of FIG. 18, showing a gripper gripping a cop, and engaged with the support section bar.

The body 74 of the gripper 29 engages with the section bar 61 by way of a resting surface 88 and a locating peg 89 (FIG. 15). A tooth 90 and the profiled end 91 of a flat spring 92, which is connected at 93 to the body 74, are disposed in undercuts 87 in the section bar 61, to keep the gripper 29 in its correct working position.

Above the gripper assembly 28 there is provided a walking surface, which is rigid with the section bar 61 and comprises a fixed cover 94 and a mobile cover 95 which are hinged together at 96. The mobile cover 95 opens automatically by rotating relative to the fixed cover 94 about the hinges 96, when the gripper assembly 28 is operated.

The operation of the doffing device according to the present invention is described hereinafter.

Figure 3:
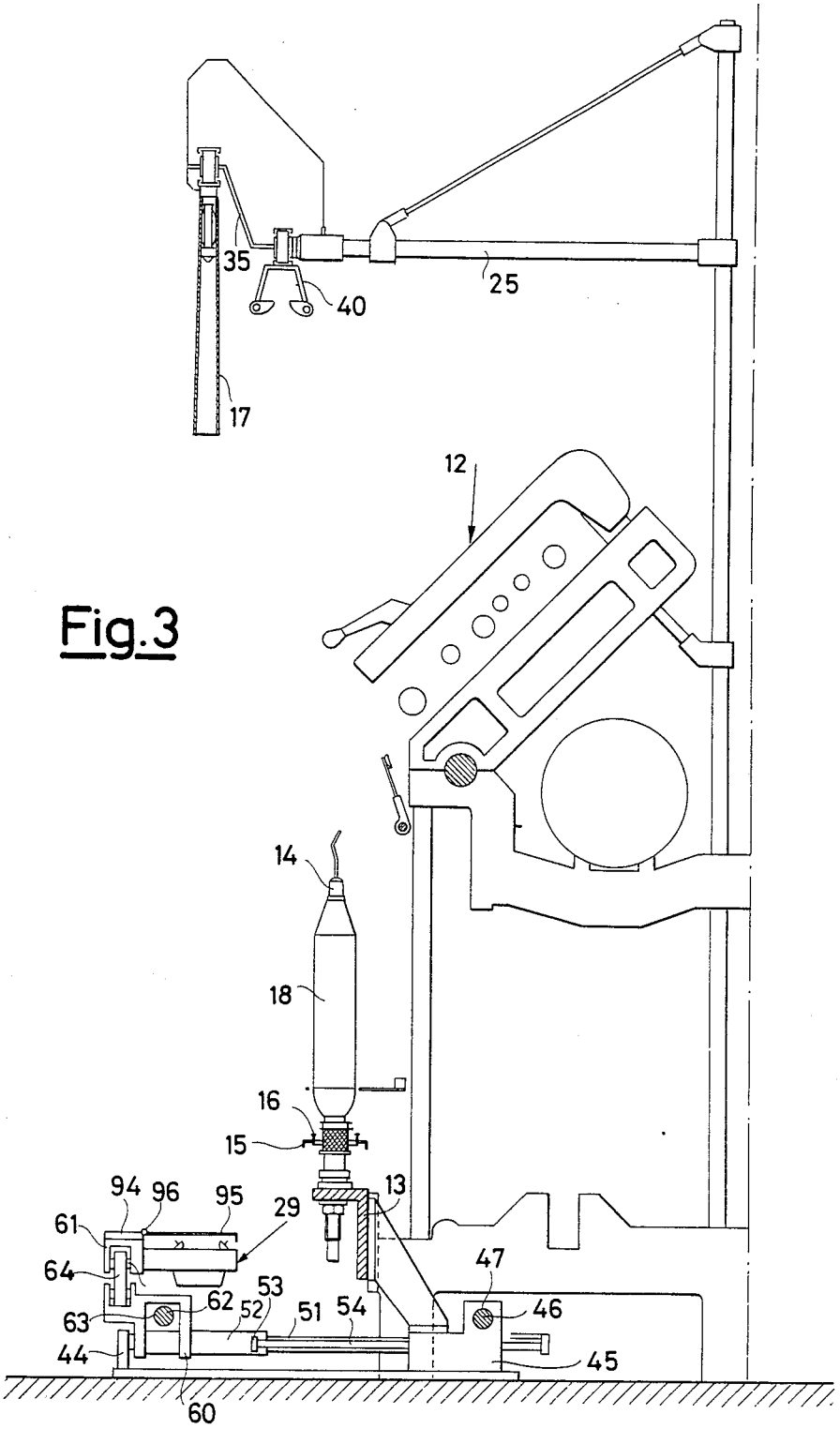
FIG. 3 is a sectional elevation of the spinning frame on the line III—III of FIG. 1, in the initial stage of the operational doffing cycle.
Figure 4:
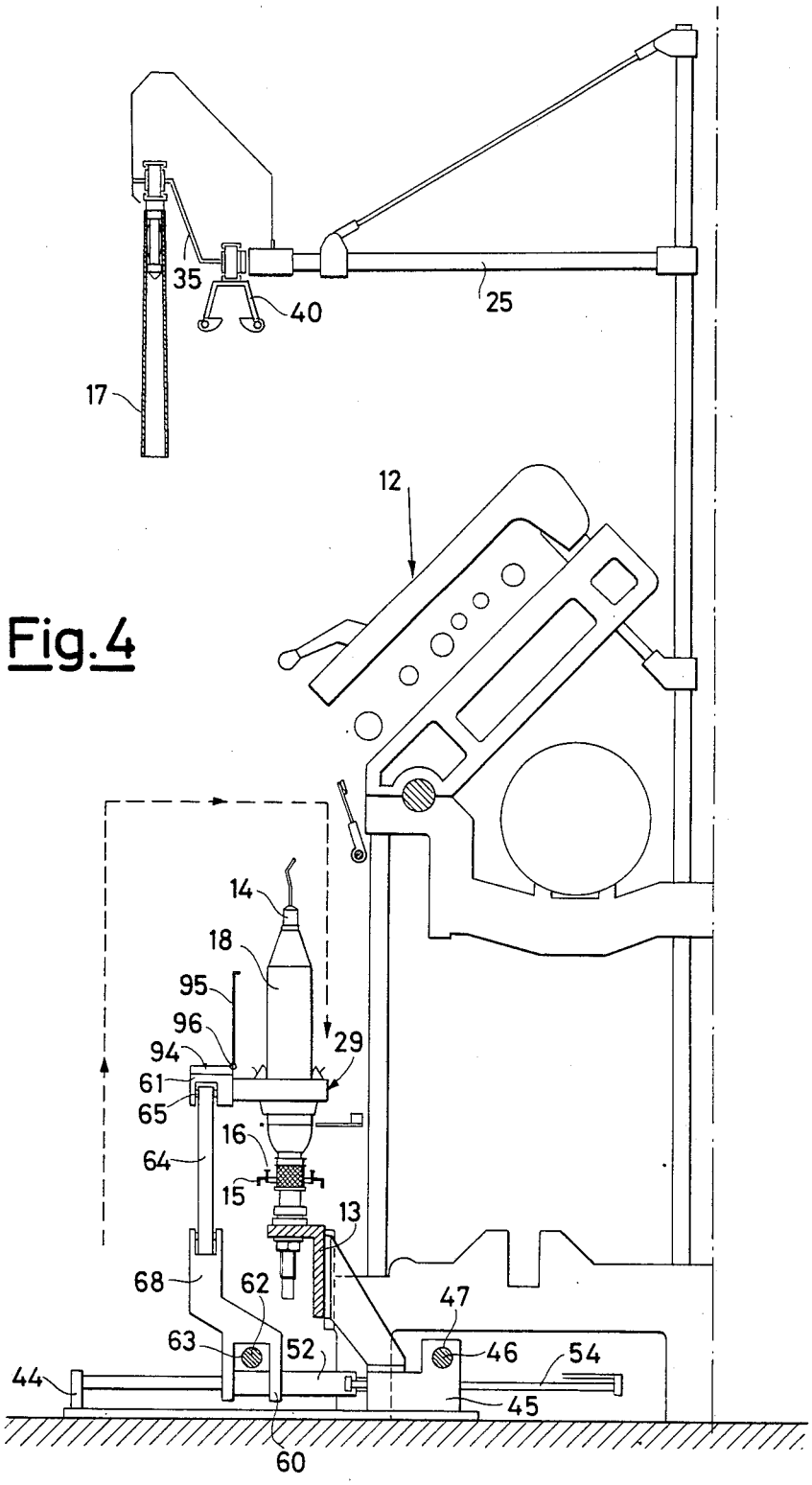
FIGS. 4, 5, 6, 7 and 8 are sections of the type shown in FIG. 3, during different successive operational doffing stages.
Figure 5:
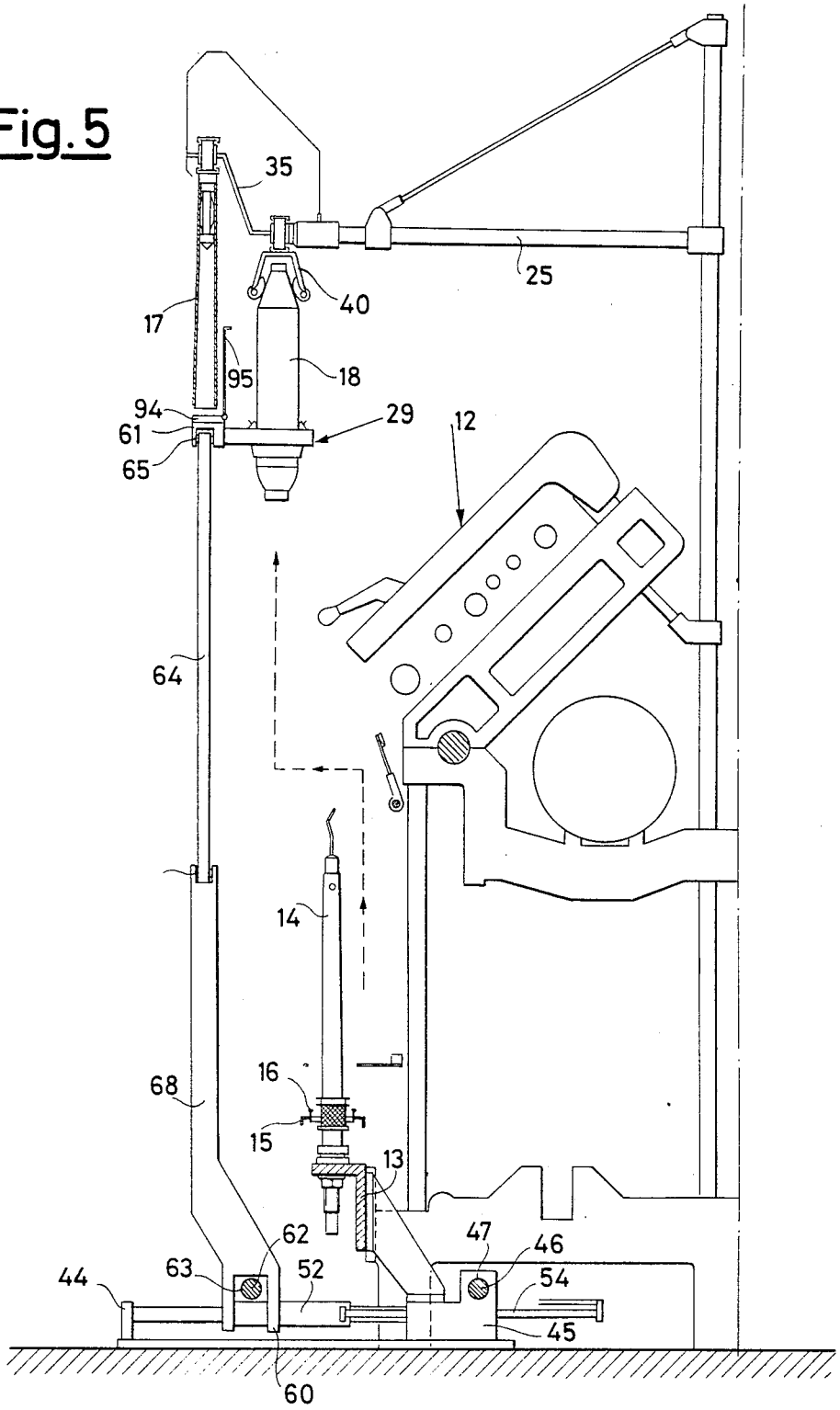

When in the rest state, the various component units of said device are disposed as shown in FIG. 3, in the following manner. The peg supporters 38 of the conveyor 23, having received the empty tubes 17 from the loader unit 22, have been moved into positions corresponding with the spindles 14, as have the empty forked supporters 40 of the conveyor 24.

The horizontal drive unit 26 and the vertical drive unit 27, in their rest position, are covered by the covers 94 and 95 which are in a horizontal position to form a walking surface for the operator. The spindle bank 13 carries cops 18 full of yarn and ready for removal, and the ring carriage 15 is disposed in its completely lowered position.

The devices and controls relative to the various operating stages, and which are disposed in the tail 19 but are not described because they are not strictly pertinent to the subject matter of the invention, induce the sequence of movements shown in FIGS. 4, 5, 6, 7 and 8. In a first stage (FIG. 4) the grippers 29 of the gripper assembly 28 are caused to grip the cops 18 full of yarn.

In this respect, the vertical drive unit 27, operated by the cylinder 71 and aided by the thrust of the leaf springs 70, is made to rise until the grippers 29 exceed the height of the cops 18, as determined by the limit switches 73.

The horizontal drive unit 26, operated by the cylinder 48, then moves the grippers 29 exactly above the individual cops 18 and on the same axis as them, this movement being limited by the limit switches 59.

At this point, the double acting cylinder 71 is operated in the reverse direction to the preceding, in order to cause the grippers 29 to descend on to the cops 18.

Figure 18:
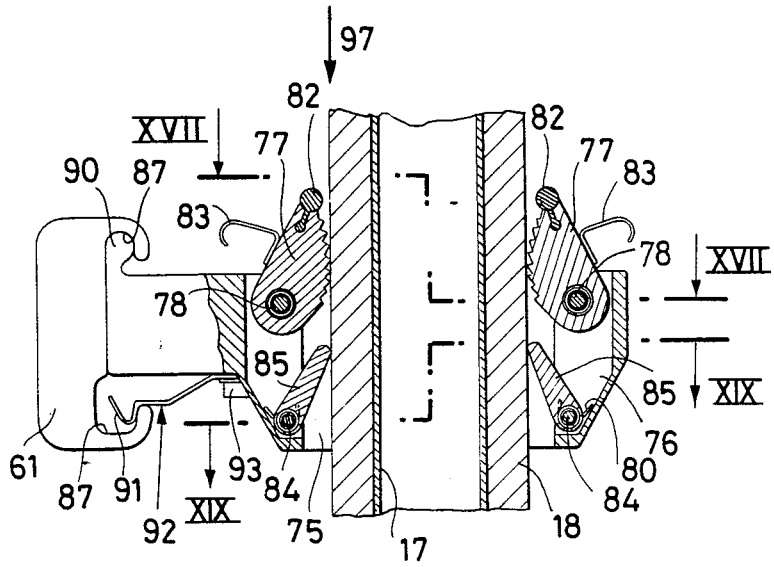
FIG. 18 is a section through the gripper of FIG. 17 on the line XVIII—XVIII of FIG. 17.
Figure 19:
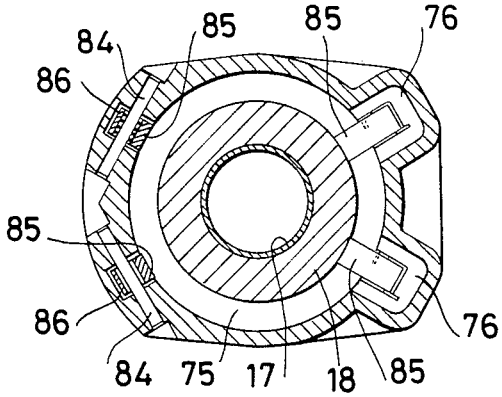
FIG. 19 is a section through the gripper of FIG. 17 on the line XIX—XIX of FIG. 18.

The sectors 77 and 85 are compelled to rotate, and come into contact with the outer surface of the cop 18 (FIG. 18), to embrace it. The toothed surface 81 of the sectors 77 specifically lock the yarn turns during the descent of the gripper on to the cop, so ensuring that said turns do not unwind.

In a second stage (FIG. 5), the cops 18 are removed from the spindles 14 by the movement of the vertical unit 27.

This is possible by virtue of the engagement of the toothed surface 81 of the sectors 77 with the outer surface of the cops 18, by which the grippers 29 drag said cops upwards and off the spindles.

This movement also causes breakage of the yarn at the collection ring 99, by virtue of the cooperation of the toothed surfaces 81 of the sectors 77 of the grippers 29, which prevent the yarn turns from unwinding from the cop 18.

Moreover, the presence of the sectors 85 in contact with the cop surfaces ensures that said cops are axially aligned with the spindles during extraction.

This vertical movement is followed by a horizontal movement and a further vertical movement, until the cops are inserted from below into the forked supporters 40 of the conveyor 24.

Figure 6:
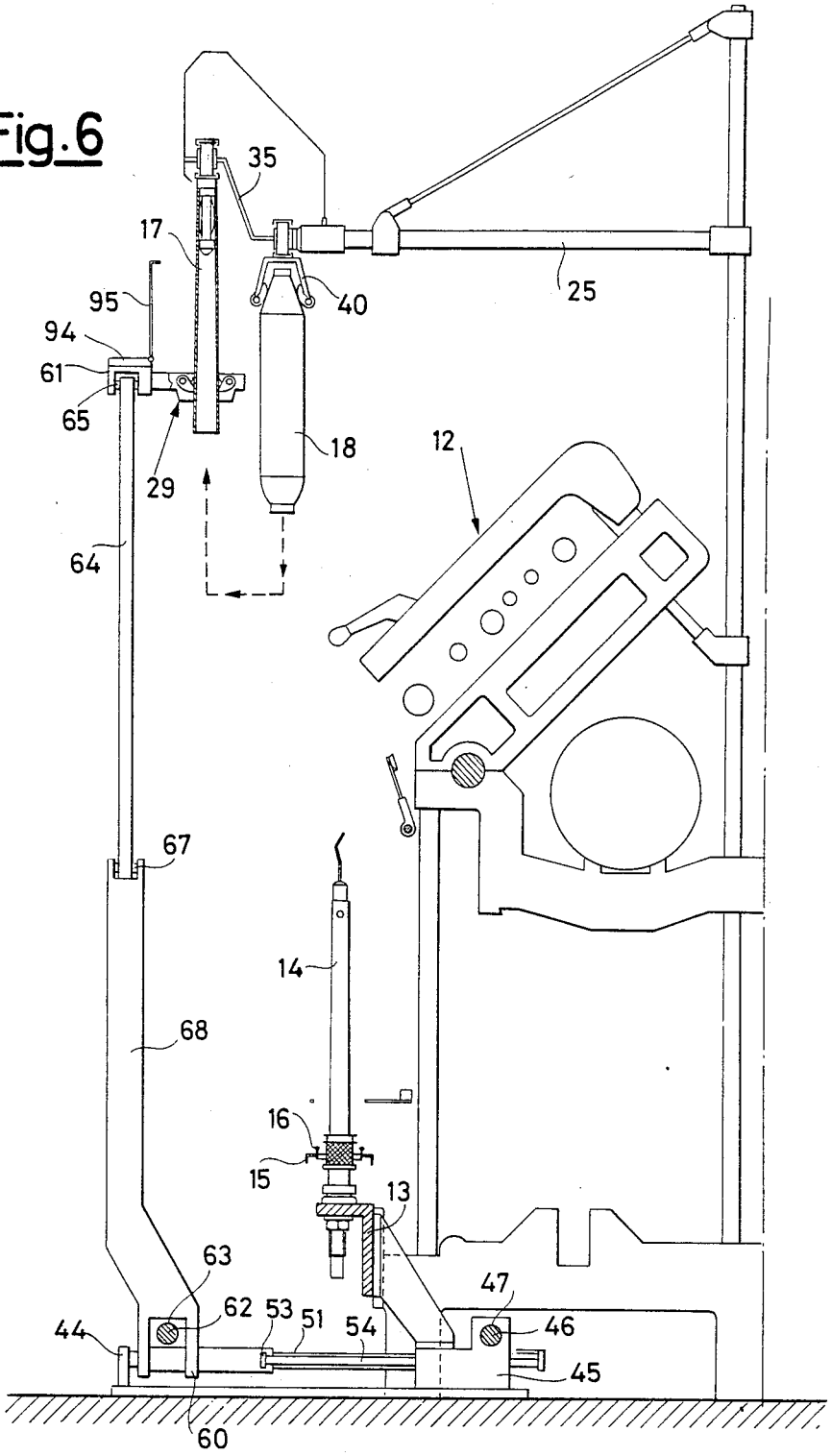
Figure 9:
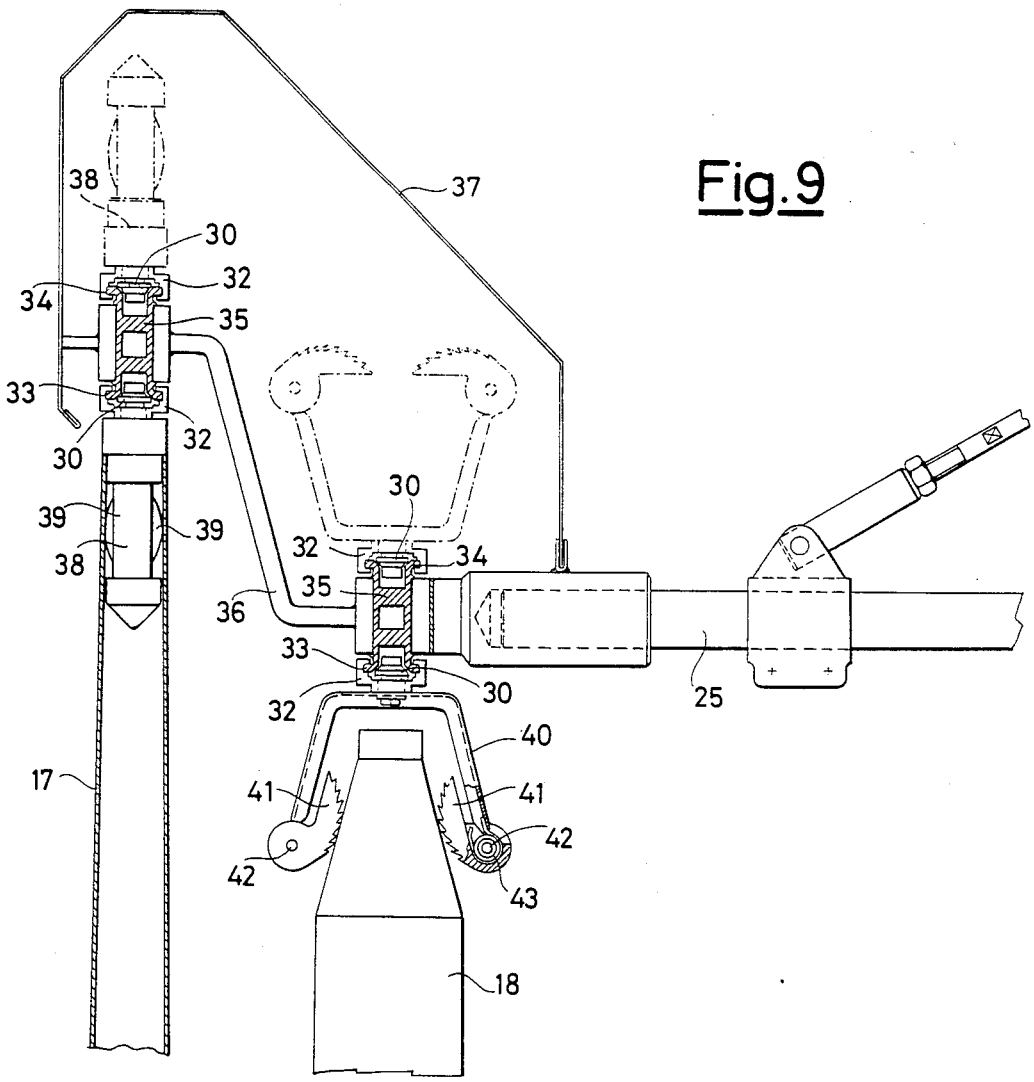
FIG. 9 is an enlarged detail of FIGS. 5 and 6, showing the conveyors carrying a cop and an empty tube.
Figure 10:
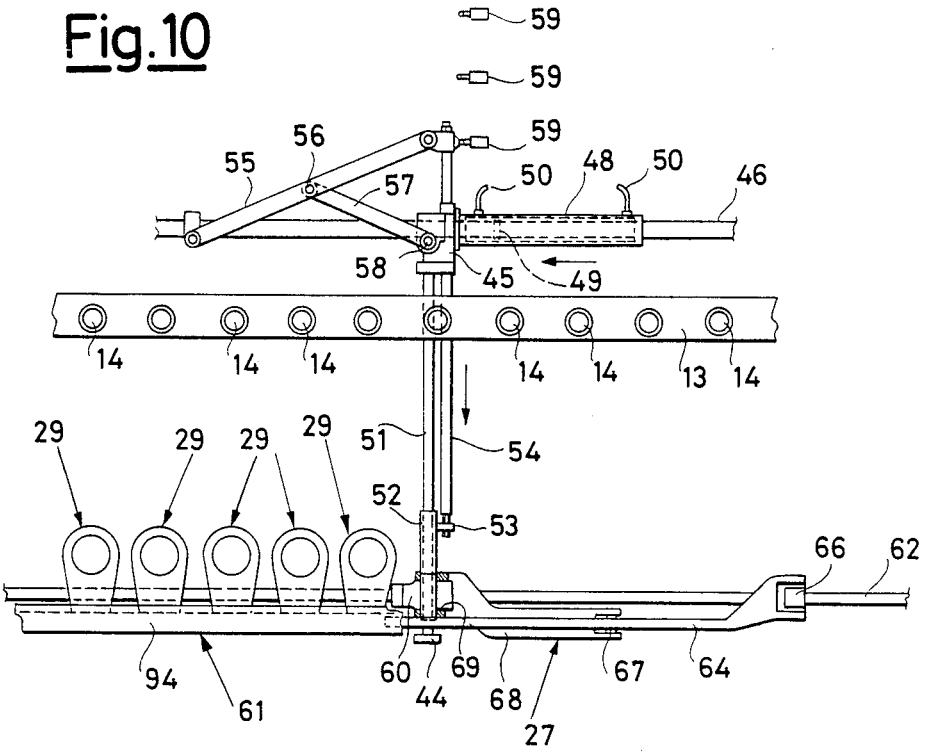
FIGS. 10 and 11 are partial plan views of the horizontal drive unit for the gripper assembly, in two different operating positions.
Figure 11:
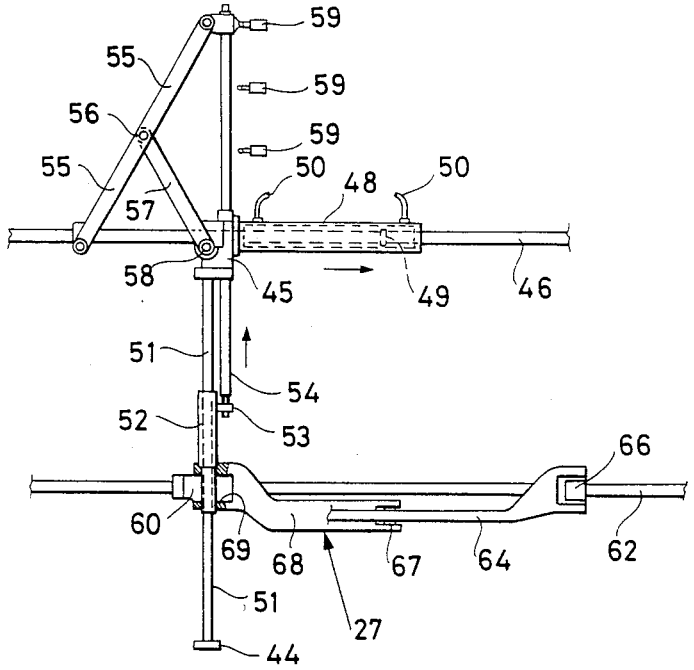
Figure 12:
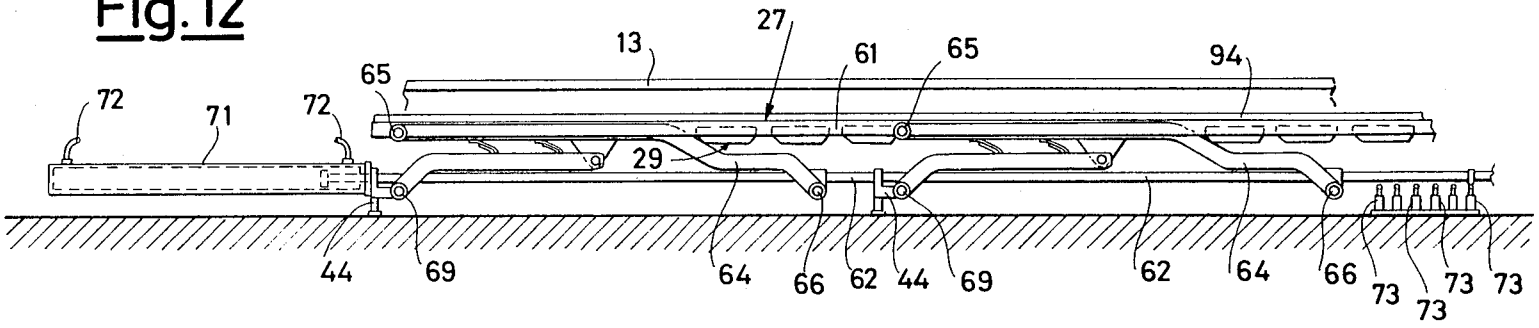
FIGS. 12 and 13 are partial elevations of the vertical drive unit for the gripper assembly, in the two extreme operating positions of minimum and maximum rise.
Figure 13:
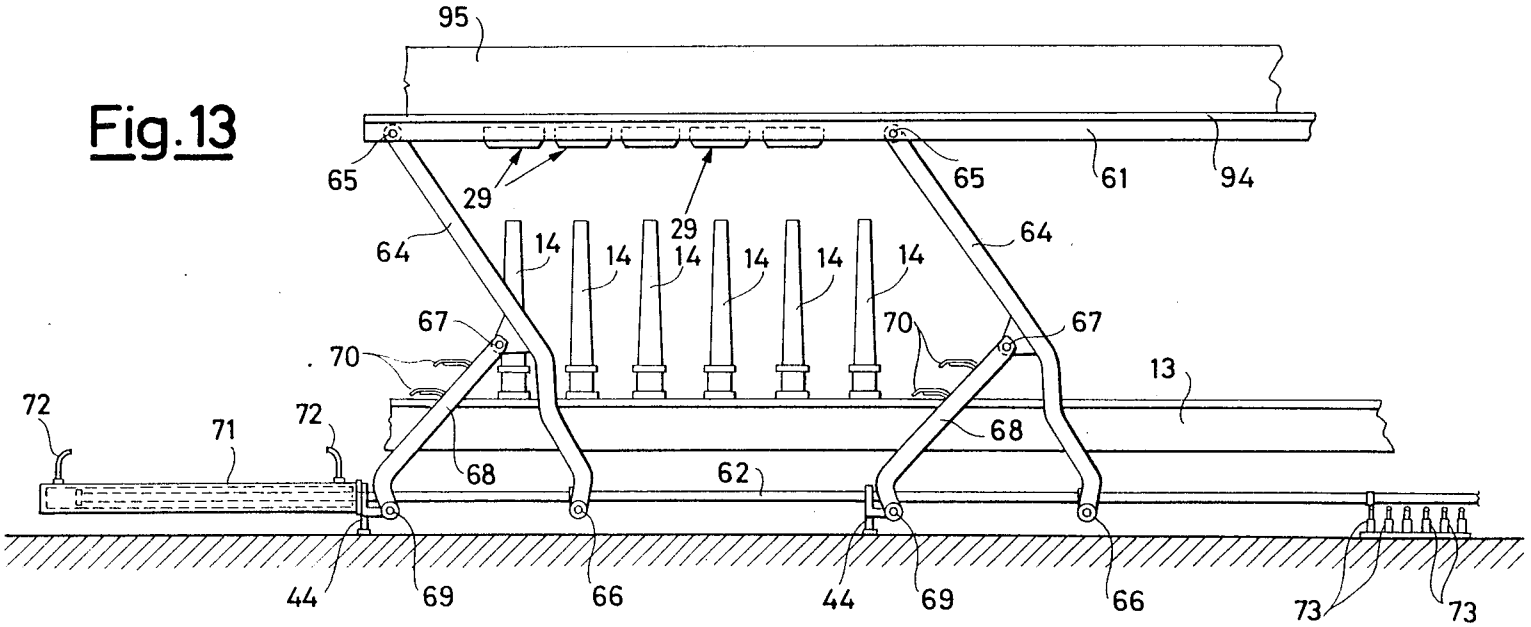
Figure 14:
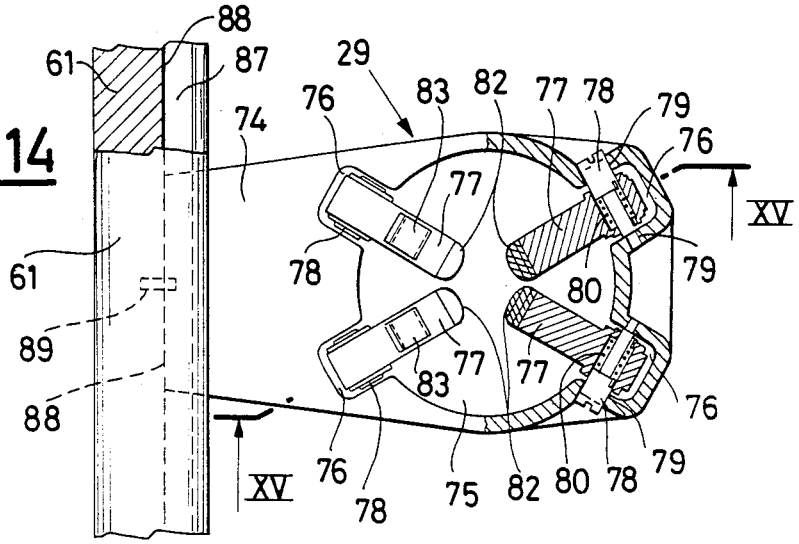
FIG. 14 is a sectional plan view on the line XIV—XIV of FIG. 15, showing a gripper in its rest position engaged with the support section bar.

This insertion causes the toothed sectors 41 of the supporters 40 to engage against the cops 18, as is apparent from FIG. 9. The vertical drive unit 27 is now operated to cause the gripper assembly 28 to descend (FIG. 6).

The toothed surfaces 81 of the sectors 77 slide along the cop 18, which is retained on the supporter 40 by the toothed sectors 41, thus ensuring that the yarn turns cannot unwind and enabling the cops 18 to be withdrawn from the sectors 41 only in the lateral direction.

A further horizontal movement and an upward vertical movement such as not to interfere with the empty tubes 17 on the conveyor 23 are now made in order to cause the grippers 29 to grip the empty tubes 17 disposed pointing downwards on the peg supporters 38 of the conveyor 23.

Figure 24:
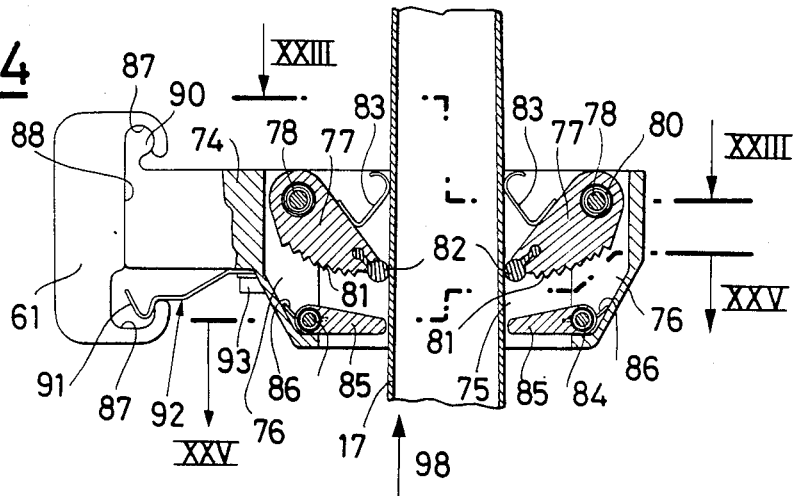
FIG. 24 is a section through the gripper of FIG. 23 on the line XXIV—XXIV of FIG. 23.
Figure 25:
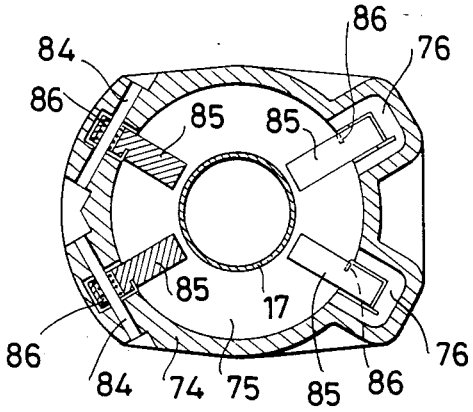
FIG. 25 is a section through the gripper of FIG. 23 on the line XXV—XXV of FIG. 24.

This gripping is effected by the engagement of the flat springs 83 and of the points 82 of soft material against the outer conical surface of the empty tubes 17 (FIG. 24).

Figure 7:
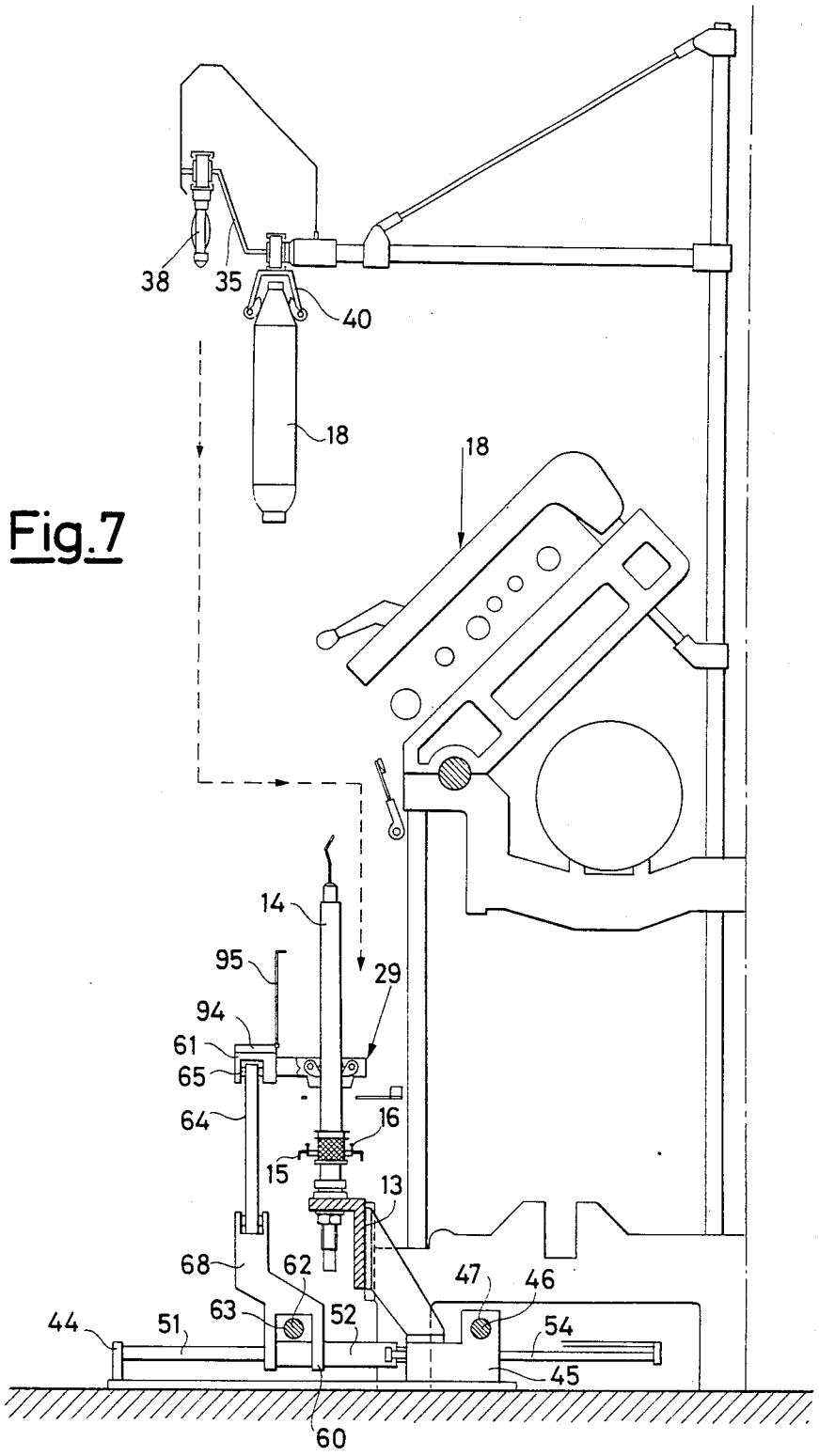
Figure 8:
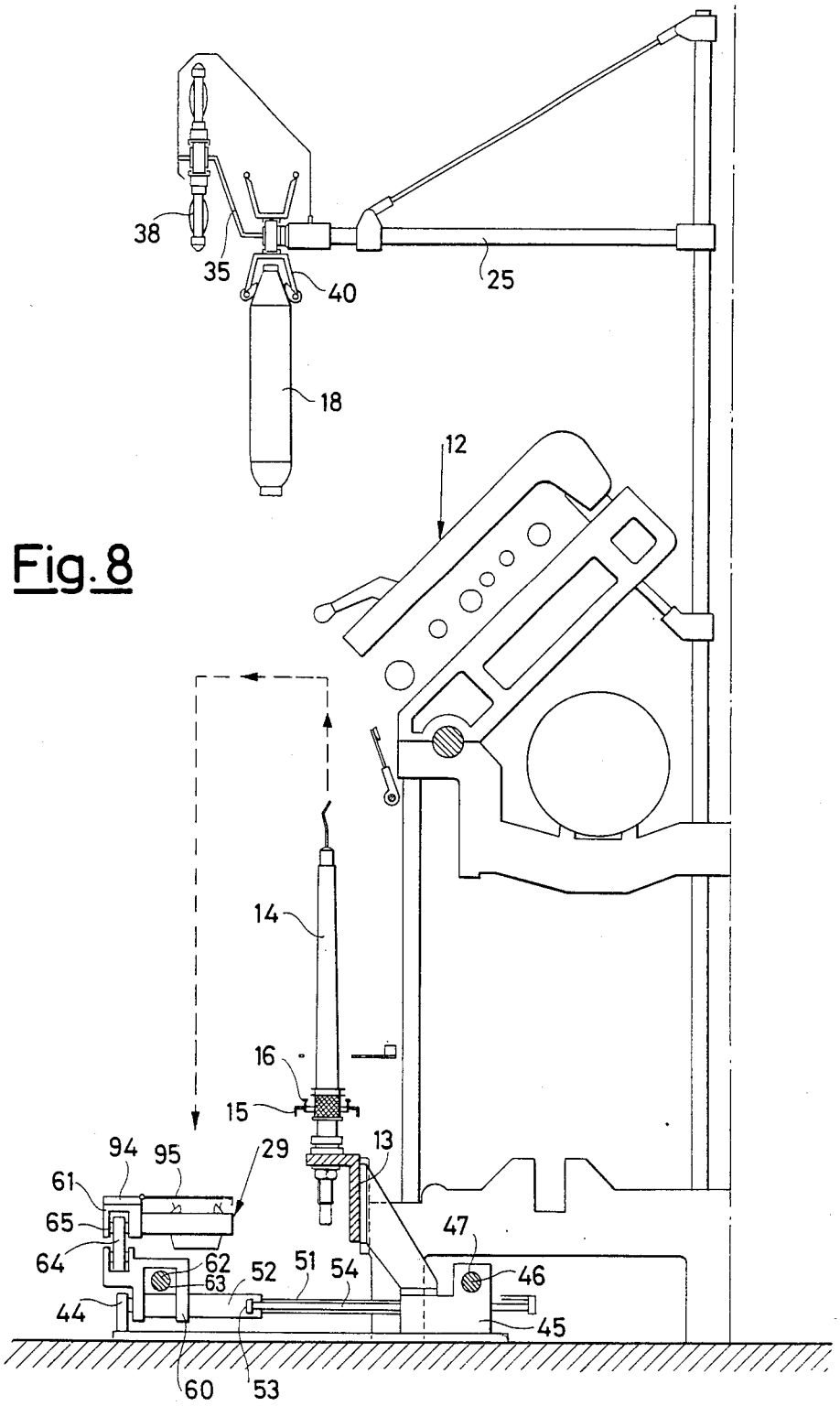

From this position, the grippers 29 are moved in accordance with the dashed line shown in FIG. 7 in order to place the empty tubes 17, withdrawn from the peg supporters 38 of the conveyor 23, on to the underlying spindles 14. The type of gripping thus obtained (FIG. 24) and the taper of the tubes 17 ensure perfect locating of the tube 17 on the spindle 14, until ideal engagement exists. The grippers 29 now return to their initial rest position by movements in accordance with the dashed line of FIG. 8, the initial upward movement causing disengagement of the flat springs 83 and points 82 from the outer surface of the tubes 17, this being aided by their taper.

Having reached the said position (FIG. 8), the gripper assembly is again covered by the mobile cover 95, which thus restores the walking surface for the operator.

Figure 20:
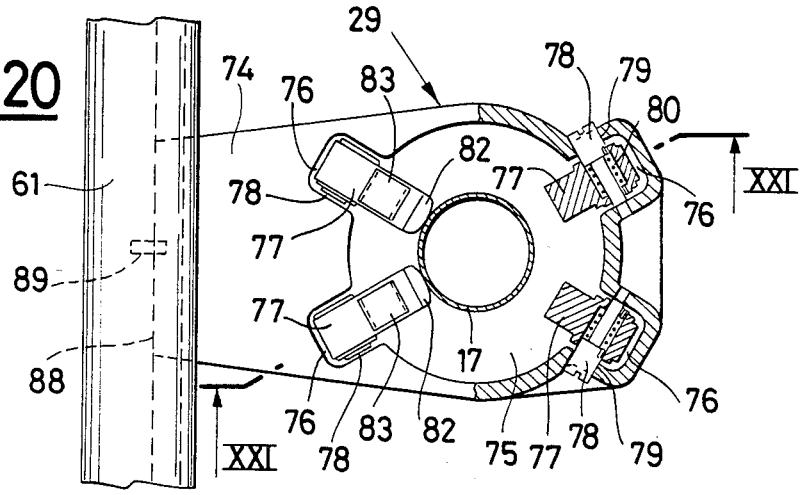
FIG. 20 is a sectional plan view on the line XX—XX of FIG. 21, showing a gripper gripping a tube or a cop which is only partially wound.
Figure 21:
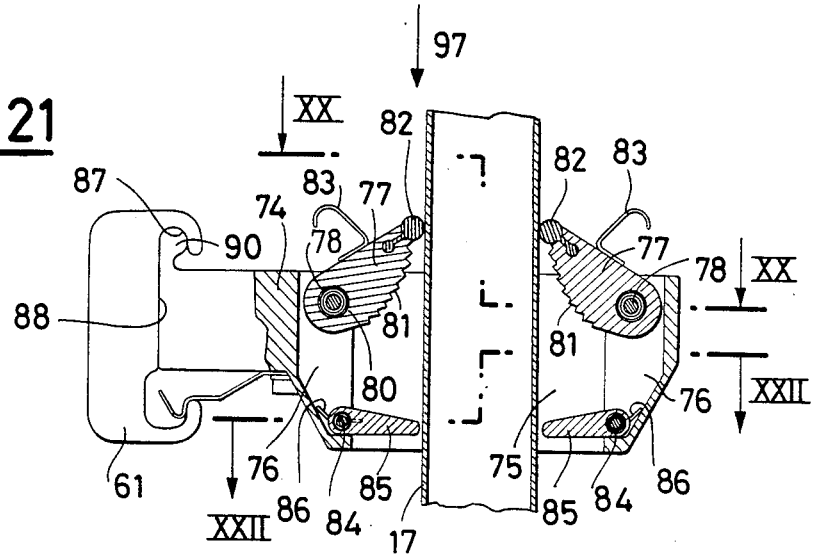
FIG. 21 is a section through the gripper of FIG. 20 on the line XXI—XXI of FIG. 20.
Figure 22:
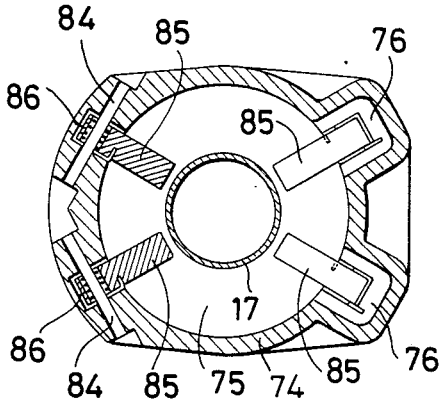
FIG. 22 is a section through the gripper of FIG. 20 on the line XXII—XXII of FIG. 21.
Figure 23:
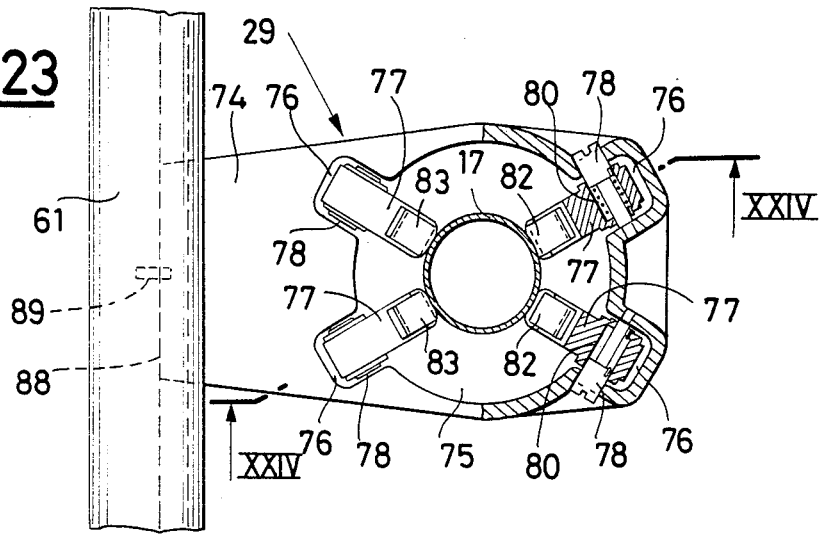
FIG. 23 is a sectional plan view on the line XXIII—XXIII of FIG. 24, showing a gripper gripping a tube in the opposite manner to that of FIG. 20.

The spinning frame is now ready for a new working cycle. FIGS. 20, 21 and 22 show that if at the end of the winding and cop creation cycle a cop is incomplete or indeed the tube has remained empty, it is equally gripped and extracted from the spindle by virtue of the presence of the soft points 82.

The formation of a walking surface, created by the closed covers 94 and 95, enables the operator to act on the spindles or even beyond them on devices which perform other functions, and which would otherwise not be accessible.

This easy accessibility is further created by the fact of having transferred the conveyors on to the spinning frame creel, thus enabling the operator to act on the spinning frame even during the loading of the empty tubes 17 on to the peg supporters 38 by the loader unit 22, and during the unloading of the full cops 18 into a suitable container located in the vicinity of the cabinet 20.

The fact that the loading of the tubes and loading of the cops by the relative conveyors can be effected during the spinning frame working cycle leads to considerable simplification of the doffing cycle, with a reduction in time and operating cost.

In this respect, these operations were previously effected manually with the machine at rest.

We claim:

1. A spinning machine having a row of spindles, a first overhead conveyor mounted above the spindles for empty bobbins to be delivered to the respective spindles, a second overhead conveyor mounted above the spindles parallel to the first conveyor for the removal of wound bobbins received from the respective spindles, independent drive means for the respective conveyors, empty bobbin supports on the first conveyor, wound bobbin supports on the second conveyor, gripper assemblies for the respective spindles, and means for moving the gripper assemblies vertically and horizontally as between the respective spindles and the first and second overhead conveyors for transferring wound bobbins from the spindles to the wound bobbin supports on the second conveyor and for delivering empty bobbins from the empty bobbin supports on the first conveyor to the spindles.

2. The invention of claim 1 wherein the first and second conveyors comprise first and second endless conveyor belts supported from an overhead creel, and wherein the bobbin supports are carried by shoes on the respective belts spaced to conform with the spacing of the spindles.

3. The invention of claim 1 wherein the empty bobbin supports comprise respective cylindrical pegs provided with lateral springs for internally gripping a tube-like bobbin, and wherein the wound bobbin supports comprise respective forks each provided with arms carrying mutually opposed pivotal toothed sectors and spring means urging the sectors toward each other, whereby a wound bobbin is gripped by pushing same between the respective sectors.

4. The invention of claim 1 wherein the gripper assemblies have a rest position below the level of the spindles and the machine includes elongate cover means for the gripper assemblies forming a walkway for a machine operator when the gripper assemblies are in the rest position.

5. The invention of claim 1 wherein the means for moving the assemblies includes a pantograph-type linkage connecting the gripper assemblies for vertical movement in unison.

6. The invention of claim 1 wherein each gripper assembly includes a generally cylindrical gripper having circumferentially spaced spring biased internal gripping segments for gripping the bobbins.

7. The invention of claim 6 wherein each gripper has plural superposed sets of gripping segments, wherein one set of the gripping segments each has a toothed inner surface, a C-shaped spring on an outer surface thereof, and a tip portion between the inner and outer surfaces provided with an insert of resilient material.

* * * * *